United States Patent [19]

Imamura et al.

[11] Patent Number: 5,049,781

[45] Date of Patent: Sep. 17, 1991

[54] DISCHARGE LAMP

[75] Inventors: Hitoshi Imamura, Yokohama; Jyunichi Nakajima, Tokyo; Shigeru Okada; Katsuyuki Ide, both of Yokohama, all of Japan

[73] Assignee: Toshiba Lighting and Technology Corporation, Tokyo, Japan

[21] Appl. No.: 478,964

[22] Filed: Feb. 12, 1990

[30] Foreign Application Priority Data

Mar. 31, 1989 [JP] Japan ..... 64-78646

[51] Int. Cl.[5] ..... H01J 17/16; H01J 61/30

[52] U.S. Cl. ..... 313/634; 313/493; 313/489

[58] Field of Search ..... 313/493, 492, 485, 495, 313/609, 610, 634; 174/176 F, 17.05, 52.3

[56] References Cited

U.S. PATENT DOCUMENTS 4,344,016 8/1982 Hoffmann et al. ..... 313/489
4,835,440 5/1989 Imamura et al. ..... 313/492
4,924,143 5/1990 Imamura et al. ..... 313/493

FOREIGN PATENT DOCUMENTS 6414860 1/1989 Japan .
1105454 4/1989 Japan .

*Primary Examiner*—Sandra L. O'Shea
*Attorney, Agent, or Firm*—Oblon, Spivak, McClelland, Maier & Neustadt

[57] ABSTRACT

A discharge lamp comprises a cylindrical lamp casing substantially formed of a metallic material, a transparent glass plate air-tightly fitted to one of the opened end of the lamp casing, a sealing stem air-tightly closing the other opened end of the lamp casing, and a pair of cathode and anode elements sealed in the lamp casing together with discharge gas. The lower portion of the lamp casing may be made in square or circular structure and may be composed of a metallic cylindrical portion extending to a half way of an axial length of the cylindrical lamp casing and a cylindrical transparent glass portion tightly surrounding the outer periphery of the metallic cylindrical portion of the further extending portion and having a front end extending to the sealing stem closing the other end of the lamp casing. The discharge lamp further comprises a member for regulating discharge generated between the paired cathode and anode elements and the interior of the discharge regulating member is divided into a plurality of luminous chambers so that the discharge lamp operates as a fluorescent lamp. The improved structure of the discharge regulating member can improve the light distribution characteristic of the fluorescent lamp.

16 Claims, 6 Drawing Sheets

DISCHARGE LAMP

BACKGROUND OF THE INVENTION

The present invention relates to a discharge lamp suitable for a display fluorescent lamp as a display element such as an electrolight display board or the like for making compact the structure of the discharge lamp and improving symmetric property of light distributing characteristic.

One example of a conventional discharge lamp is shown in FIGS. 17 and 18. Referring to FIGS. 17 and 18, an illustrated discharge lamp comprises a bottomed lower cylindrical portion 301 made of ceramics and a bottomed upper cylindrical portion 302 also made of ceramics and mounted on the opened upper end portion of the lower cylindrical portion 301 coaxially therewith.

The interior of the upper cylindrical portion 302, as shown in FIG. 18, is divided into a plurality of, three in the illustration, luminous chambers 304*a*, 304*b* and 304*c* circumferential direction thereof, for example, by a Y-shaped partition wall 303, and the walls of the respective chambers 304*a*, 304*b* and 304*c* are coated with, for example, light emitting films of red color R, green color G and blue color B, respectively. The opened upper end portion of the upper cylindrical portion 302 is air-tightly sealed by a flat transparent glass plate 305 so as to constitute an air-tight tube 306.

The lower cylindrical portion 301 is provided with a central recess into which a common cathode 307 is sealed and with three circumferential recesses formed in the outer peripheral portions of the lower cylinder 301 into which anodes 308*a*, 308*b* and 308*c* are arranged in a manner corresponding to the luminous chambers 304*a*, 304*b* and 304*c*, respectively.

In the bottom portions of the respective luminous chambers 304*a*, 304*b* and 304*c* of the upper cylinder 302 are formed discharge holes 309*a*, 309*b* and 309*c* at the central portions of the chambers and discharge holes 310*a*, 310*b* and 310*c* at the outer peripheral portions of the chambers in a manner that the discharge caused between the cathode 307 and the anodes 308*a*, 308*b* and 308*c* pass these holes. Accordingly, when the cathode and the anodes are conducted and the discharge is caused between the cathode and desired one of anodes, the discharge passes corresponding one of the discharge holes into the corresponding one of the light emitting chambers, in which ultraviolet rays are generated and the light emitting film of the desired chamber is excited and lightened by the ultraviolet rays, whereby the light of the desired color is emitted outwardly through the transparent glass plate 305.

However, the conventional discharge lamp of the type described above, the upper and lower cylindrical portions are made of ceramics which have relatively thick walls and, hence, heavy weights. The ceramics cylindrical portions are inferior in the working performance and workability and in strength when the walls are made thin.

Furthermore, with a discharge lamp as a fluorescent lamp, there is a problem to be unavoidable such that a chromaticity of the white light at the time of all-chamber light emission deteriorates due to the asymmetric light distribution characteristic.

SUMMARY OF THE INVENTION

An object of the present invention is to substantially eliminate the defects encountered by the prior art and to provide a discharge device, particularly of fluorescent lamp type, which can be manufactured by an easy process and has a compact structure.

Another object of the present invention is to provide a discharge lamp, particularly of fluorescent lamp type, capable of improving the symmetry of the light distributing characteristic.

These and other objects can be achieved according to the present invention by providing a discharge lamp comprising, a metallic cylindrical lamp casing opened at both ends thereof, a transparent glass plate air-tightly fitted to one of the opened end of the lamp casing, a sealing member air-tightly closing the other opened end of the lamp casing and a pair of electrodes of cathode and anode elements sealed in the lamp casing together with discharge gas.

In preferred embodiments of the lamp casing of the character described above, an inner surface of the metallic cylindrical lamp casing is coated with a glass film coating. The sealing member comprises a button stem and the anode element is disposed near said transparent glass plate and the cathode means is embedded in said button stem.

In addition, the metallic lamp casing comprises a first staged portion for supporting air-tightly the transparent glass plate, a second staged portion formed downward the first staged portion and a portion downwardly extending from the second staged portion, the first and second staged portions and the further extending portion being formed integrally with each other. The first and second staged portions and the further extending portion are each of square cross section and, otherwise, the further extending portion may be formed so as to have a circular cross section. The further extending portion comprises a metallic cylindrical portion extending to a half way of an axial length of the cylindrical lamp casing and a cylindrical transparent glass portion surrounding an outer periphery of the metallic cylindrical portion of the further extending portion and having a front end extending to the sealing member closing the other end of the lamp casing.

Furthermore, the discharge lamp comprises a member for regulating discharge generated between the paired cathode and anode members and the discharge regulating member is supported in the lamp casing by the second staged portion. The discharge regulating member comprises a main body formed in quadrangular truncated pyramid shape having downwardly forwardly tapered end and a cylindrical portion formed integrally with the tapered end portion of the main body, an upper open end of the main body having a shape substantially corresponding to an inner periphery of the one open end of the lamp casing and the cylindrical portion extending from the tapered lower end of the main body being of a cross section in conformity with a cross section of the further extending portion.

Moreover, the cylindrical portion extending from the tapered lower end of the main body has an outer diameter substantially equal to an inner diameter of the further extending portion of the lamp casing.

The discharge regulating member further comprises a crossed partition plate as a diaphragm partitioning an interior of the main body into a plurality of luminous chambers each of the same shape. The inner walls of the luminous chamber are coated with light emitting substance and the anode member is arranged for each luminous chamber so as to constitute a discharge lamp as a fluorescent lamp.

The discharge lamp further comprises a circular conical member being counter to the tapering portion of the main body for a direction being expanded taperingly and being provided coaxially within the tapering portion, a top end portion of the circular conical member being coincident with a crossed end portion of the crossed partition plate.

The bottom end portion of the cylindrical portion extending from the tapered lower end of the discharge regulating member is provided with a plurality of discharge holes acting for throttling the positive column generated during the discharge between the cathode and the anodes, the discharge holes being arranged on the central axes of the respective luminous chambers.

According to these characters of the discharge lamp of the present invention, the lamp casing of the discharge lamp is formed of a metallic cylinder which can easily be manufactured by a punching working with high accuracy, thus making thin the thickness of the cylinder wall and, hence, reducing the total weight of the discharge lamp itself. The inner surface of the lamp casing is coated with a glass substance, whereby the lowering of the lighting efficiency of the discharge lamp due to the impure gas generated during the discharge can be effectively reduced. The cylindrical portion of the lamp casing can be formed with staged portions and a straight portion so as to effectively support the glass plate mounted on the top of the casing and also support the discharge regulating member disposed in the lamp casing. The interior of the discharge regulating member is divided into a plurality of luminous chambers having inner wall coated with fluorescent films to radiate desired color, thus operating as a fluorescent lamp.

In addition, the lower portion of the discharge regulating member may be formed into a straight drum shape portion having an outer diameter approximately to an inner diameter of the further extending portion of the lamp casing, so that the symmetry of each luminous chamber can be improved about the central axis of the luminous chamber. The location of the discharge hole formed coaxially with the central axis of the luminous chamber can also improve the light distribution characteristic, and this feature may be enhanced by arranging the conical member in the tapered main body of the discharge regulating member.

The application of the transparent glass cylindrical portion to the further extending portion of the lamp casing allows the visual observation of the cathode arrangement.

DESCRIPTION OF THE PREFERRED EMBODIMENTS

Figure 1:
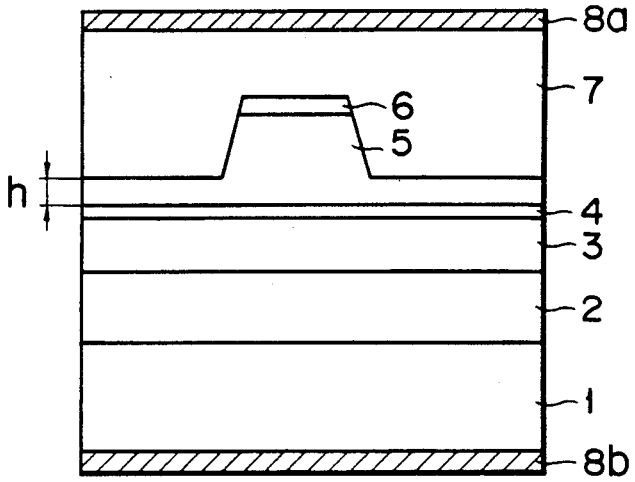
FIG. 1 (PRIOR ART)
FIG. 1 is a perspective view of the first embodiment of a discharge lamp according to the present invention.
Figure 2A:
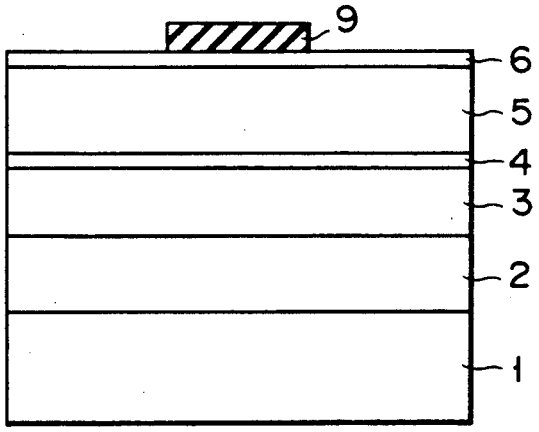
FIG. 2A (PRIOR ART)
FIG. 2 is an elevational section taken along the line II—II shown in FIG. 1.
Figure 2B:
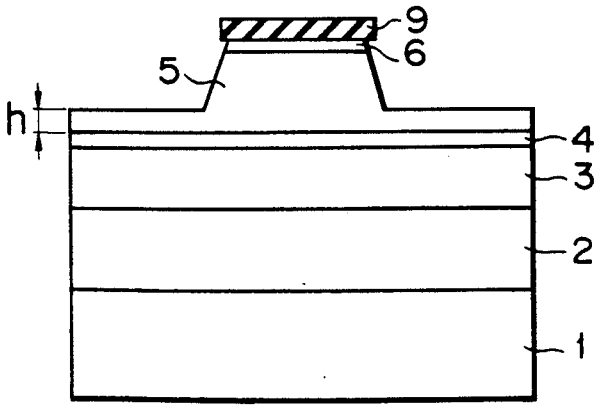
FIG. 2B (PRIOR ART)

FIG. 1 shows an entire structure of a discharge lamp of the first embodiment according to the present invention.

Referring to FIG. 1, a lamp casing 1 is formed by punching a metallic plate such as stainless steel or iron into cylindrical form of rectangular cross section and provided with axial ends, upper and lower ends as viewed, as open ends.

Figure 3:
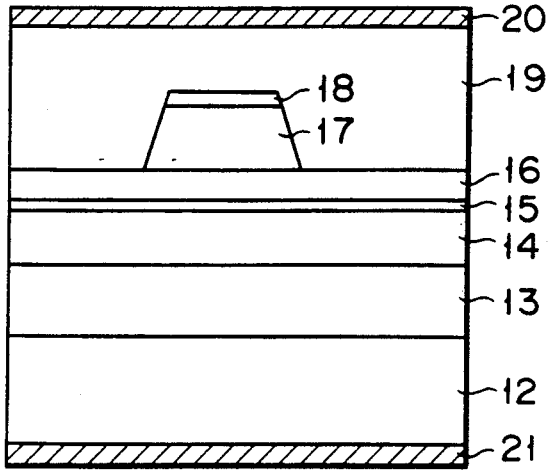
FIG. 3 is a developed perspective view of the discharge lamp shown in FIG. 1.
Figure 2:
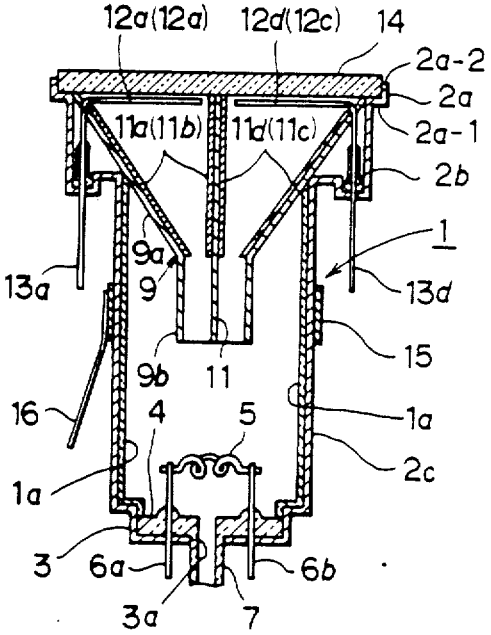
Figure 3:
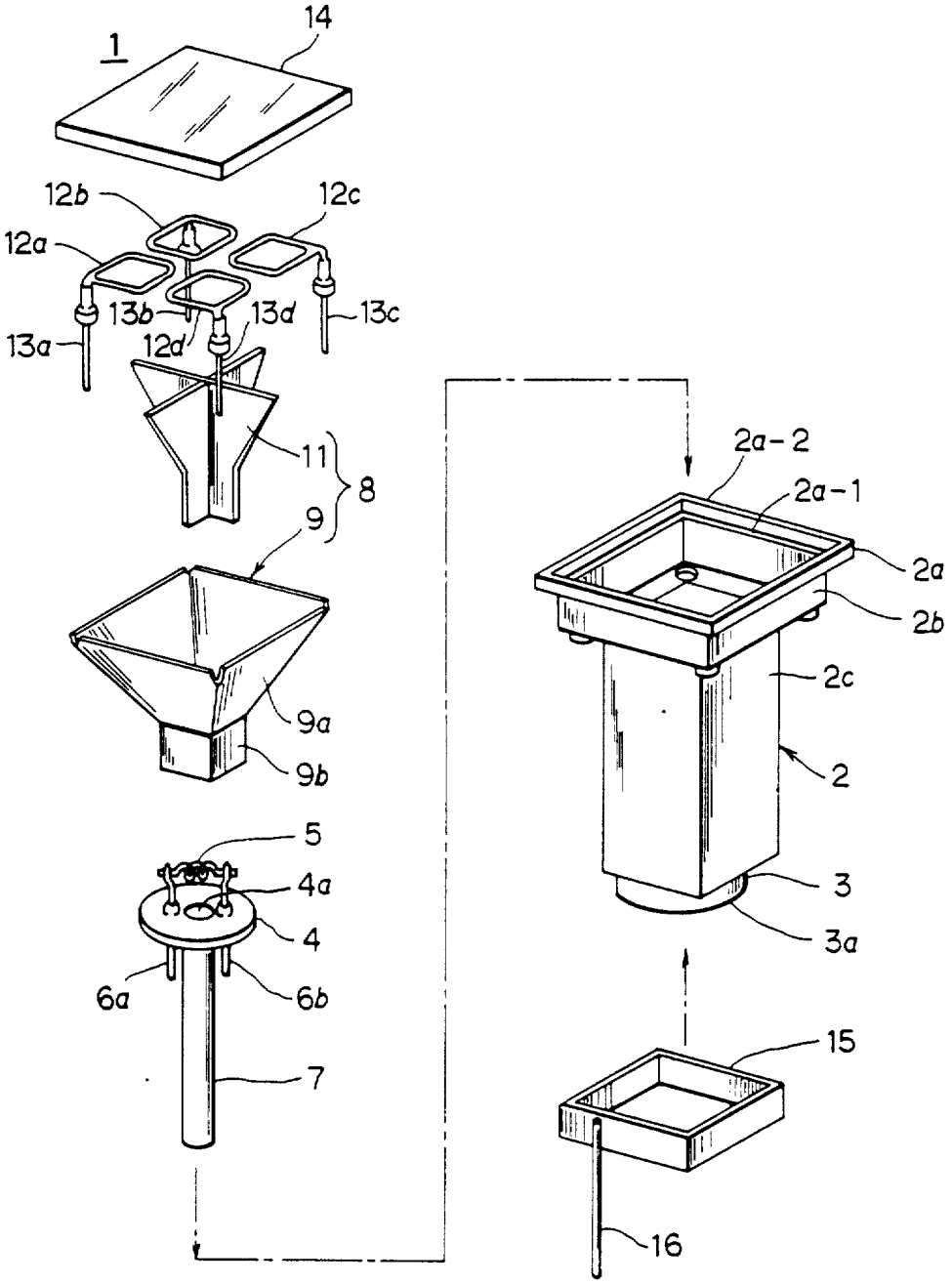
Figure 4A:
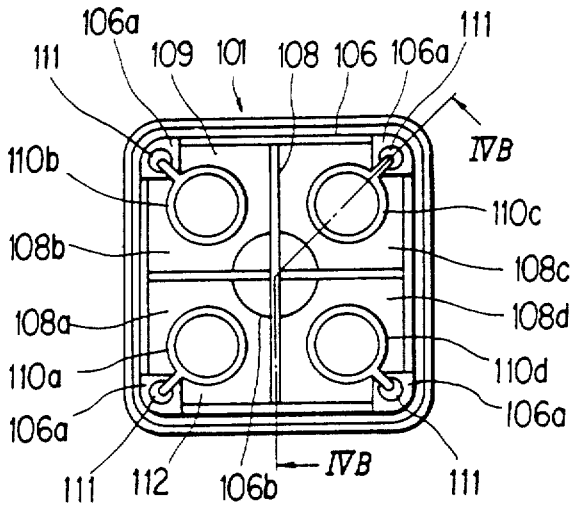
Figure 4B:
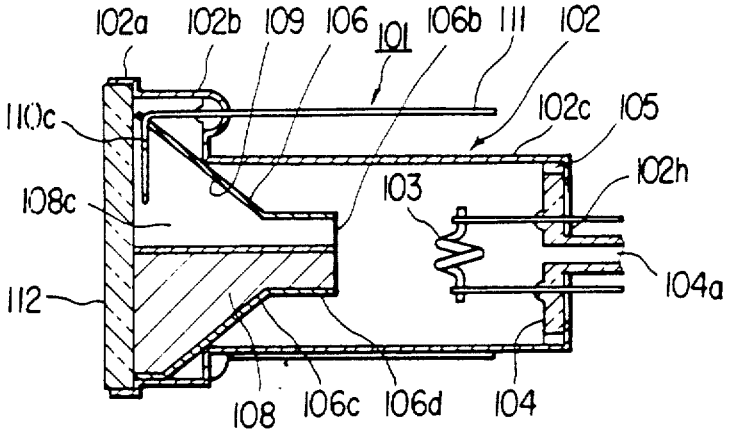
Figure 5:
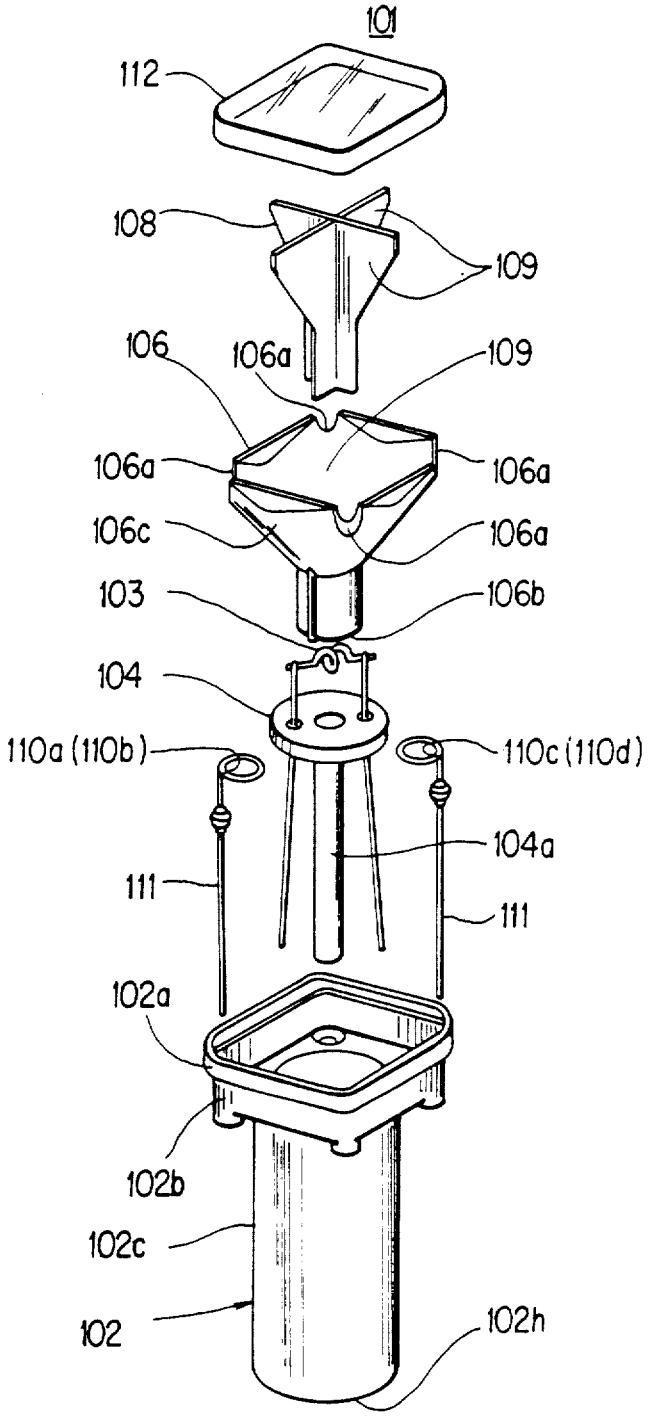
Figure 6:
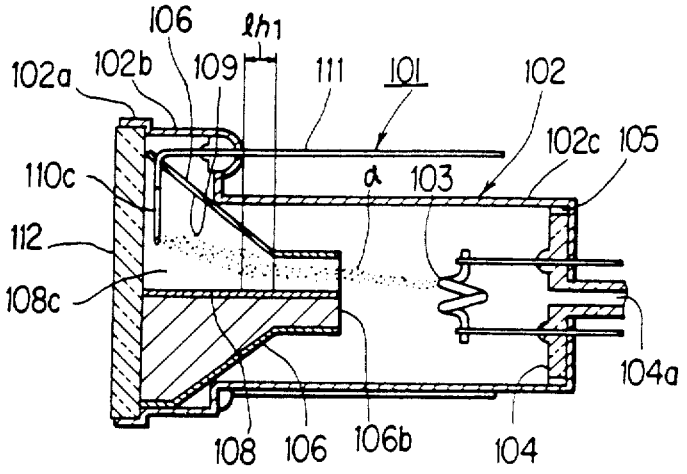
Figure 7:
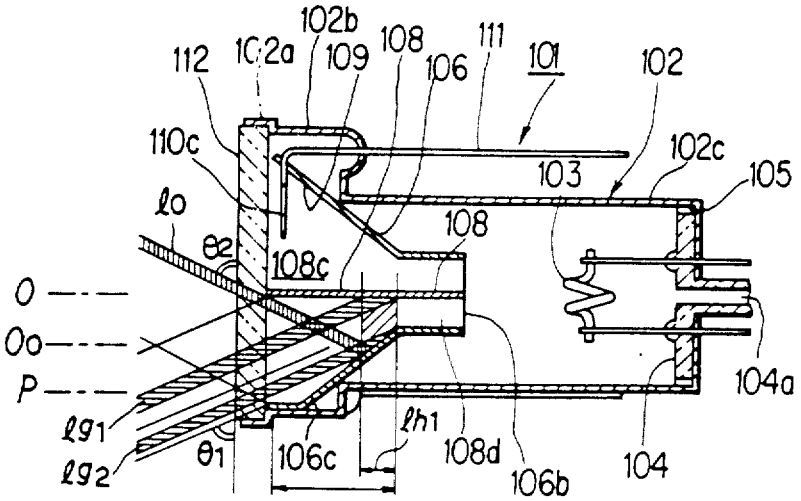

The opened upper end portion of the lamp casing 1 is composed of upper and lower staged portions 2*a* and 2*b* by two sequential widening or expanding steps as shown in FIGS. 2 and 3. The inner peripheral surface of the wall of a portion 2*c* of the lamp casing 1 further extending from the lower staged portion 2*b* to the subsequent lower portion of the casing 1 is coated by a glass film coating 1*a* to prevent or reduce the impure gas from discharging when the discharge is caused in the lamp casing 1. The lamp casing 1 is provided with a bottom portion to which a circular cylindrical portion 3, having a diameter slightly smaller than the width of the bottom portion, is integrally formed and a bottom central portion 3*a* is formed in the central portion of the cylindrical portion 3.

The structure of this embodiment will be described in detail hereunder in accordance with the assembling order in conjunction with FIG. 3.

A disc like glass button stem 4 is inserted, as shown in FIG. 3, into the lamp casing 1 so as to tightly fit in the circular cylindrical portion 3 of the casing 1. Then, the inserted button stem 4 is fuse-fixed thereto by means of glass frit or high frequency heating. A cathode 5 being one of a pair of discharge electrodes is embedded in the button stem 4 and the both ends of the cathode 5 are supported by a pair of lead wires 6*a* and 6*b* which penetrate the button stem 4 in the thickness direction thereof and extend therefrom and are electrically connected to a lighting circuit, not shown.

The button stem 4 is further provided with a central hole 4*a* at the central portion thereof and a discharge tube 7 made of glass communicating with the central hole so that the front end, the lower end in the illustration of FIG. 3, extends outwardly from the central hole 3*a* of the cylindrical portion 3 of the lamp casing 1 when the button stem 4 is fitted air-tightly into the cylindrical portion 3. Accordingly, the button stem 4 can easily be secured to the cylindrical portion 3 by means of the glass frit with the inserted condition with the discharge tube 7 downward, whereby the cathode 5 can be arranged very easily and accurately and, moreover, the leakage of the discharge gas sealed in the lamp casing can be effectively prevented.

The portion 2*c* downwardly extending from the lower staged portion 2*b* of the lamp casing 1 may be formed with a metallic portion and a transparent glass portion as will be described hereinafter with reference to FIG. 10.

Further, as shown in FIG. 3, an outer casing 9 of a discharge regulating member 8 is inserted into the lamp casing 1. The discharge regulating member 8 comprises the outer casing 9 and a partition plate 11, for example, in cross shape, partitioning the interior of the outer casing 9 into four luminous chambers, for example, 10*a*, 10*b*, 10*c* and 10*d*. The inner surfaces of the outer casing 9 facing the luminous chambers 10*a* to 10*d* and the outer surface of the partition plate 11 are coated by fluorescent films 11*a*, 11*b* 11*c* and 11*d* with fluorescent colors different with respect to the respective luminous chambers 10*a* to 10*d*.

The outer casing 9 comprises a main body 9*a* formed in quadrangular truncated pyramid shape having downwardly frontwardly tapered end as shown in FIGS. 1 to 3 and a rectangular cylindrical portion 9*b* formed integrally to the tapered lower end of the main body 9*a*. The inner surface of the rectangular cylindrical portion 9*b* is not coated with any fluorescent film 11*a*, 11*b*, 11*c* or 11*d*.

The outer casing 9, as shown in FIG. 2, is supported in the lamp casing 1 such that the outer surface of the axially intermediate portion of the outer casing 9 is engaged with respective corner portions of the lower staged portion 2*b*. After the insertion of the outer casing 9 into the lamp casing 1, the crossed partition plate 11 is fitted into the outer casing 9. Thereafter, four, for example, anodes 12*a*, 12*b*, 12*c* and 12*d* are inserted into the lamp casing 1 so that the front ends of lead wires 13*a*, 13*b*, 13*c* and 13*d* of the respective anodes penetrate air-tightly the bottom of the lower staged portion 2*b* of the lamp casing 1 and extend outwardly to be electrically connected to a lighting circuit, not shown.

The respective anodes 12*a* to 12*d* are formed into a rectangular loop and arranged on the inner upper ends of the respective luminous chambers 10*a* to 10*d* of the discharge regulating member 8 coaxially in conformity with the upper end shapes of the chambers so as to rectangularly surround the inner peripheries of the chambers, respectively.

In the next step, the flat rectangular transparent glass plate 14 is fitted into the upper staged portion 2*a* of the lamp casing 1 in a manner such that the inner surface of the glass plate 14 abuts against the upper ends of the outer casing 9 and the partition plate 11 of the discharge regulating member 8 and so fixed to the upper staged portion 2*a* by means of the glass frit, thus the transparent glass plate 14 acting as a transparent window member for the discharge lamp. Accordingly, the discharge regulating member 8 can be supported at the upper and lower sides by the transparent glass plate 14 and the lower staged portion 2*b* and, hence, the mounting of the discharge regulating member 8 in the lamp casing 1 can be easily performed.

Moreover, the upper staged portion 2*a* is composed of a staged portion 2*a*-1 bearing the inner surface of the glass plate 14 and a build-up portion 2*a*-2 rising upwardly perpendicularly, as viewed, so as to air-tightly surround the outside surfaces of the glass plate 14, whereby the glass plate 14 can be firmly supported on the upper staged portion 2*a*.

After these assembling processes, as shown in FIG. 3, an outer electrode 15 formed of a metallic belt-like plate in rectangular shape is fitted air-tightly to the outer peripheral surface of the lamp casing 1 from the lower side thereof and secured between the cathode 5 and the anodes 12*a* to 12*d*. A lead wire 16 of the outer electrode 15 is electrically connected to a desired lighting circuit. The purpose of the location of the outer electrode 15 resides in the lowering of the starting voltage of the discharge lamp by facilitating ionization of the discharge space between the cathode 5 and the anodes 12*a* to 12*d*.

The portion 2*c* extending from the lower staged portion 2*b* of the lamp casing 1 of FIG. 1 may be formed into a cylindrical shape as shown in FIG. 1 and in such case the other members, such as the outer electrode 15 and the cylindrical portion 9*b* of the discharge regulating member 8, may be formed into shapes in conformity with the cylindrical shape of the further extending portion 2*c* of the lamp casing as will be described hereinafter with reference to FIG. 5.

The embodiment of the discharge lamp of the structure described above will operate as follows.

When the cathode 5 is conducted to desired one 12*a* of the anode, for example, and a predetermined voltage is applied to the outer electrode 15, the ionization at a portion about the outer electrode 15 in the lamp casing 1 is facilitated and a discharge is caused between the cathode 5 and the anode 12*a* by a relatively low starting voltage and ultraviolet rays are then generated. The ultraviolet rays excite a desired fluorescent film 11*a* of the luminous chamber 10*a* provided with the anode 12*a* and then radiates a desired color, which then projects externally through the transparent glass plate 14 constituting the window of the discharge lamp.

The light emitted in the luminous chamber 10*a* is prevented from projecting through the side of the lamp casing 1 because the lamp casing 1 is made of a metallic material and thus provided with light shielding property, whereby the mixture of the colors emitted from adjacent discharge lamps can be substantially prevented in a case where a number of these discharge lamps are arranged side by side for constituting an electrolight display board, for example.

On the other hand, the discharge is generated between the cathode 5 and all the anodes 12*a* to 12*d*, the ultraviolet rays in all the luminous chambers 10*a* to 10*d* excite all the fluorescent films 11*a* to 11*d* and radiate the respective colors, so that the mixed color such as white color is projected externally through the transparent glass 14.

According to the present embodiment, since the lamp casing 1 is made of a metallic material, it can easily be worked and thus made thin in comparison with the ceramics material, thus making compact the discharge lamp itself. In addition, the inner peripheral surface of the metallic lamp casing 1 is entirely covered with the glass film 1*a*, so that the lowering of the lighting efficiency of the discharge lamp due to the generation of the impure gas from the lamp casing 1 can be obviated. Moreover, since the button stem 4 embedded in the cathode 5 can be easily fitted into the lamp casing 1, the assembling working of the discharge lamp can be improved. The discharge space in the lamp casing 1 is divided into a plurality of discharge compartment by the provision of the discharge regulating member 8, various colors can be emitted from the fluorescent films 11*a* to 11*d* applied on the wall surfaces of the respective discharge compartment. The discharge regulating member H can be easily and firmly supported and secured in the lamp casing 1 by the transparent glass plate 14 and the lower stage portion 2*b* of the casing 1.

With the foregoing embodiment, the light distribution characteristic may become asymmetric in the case of so-called single-chamber light emission where only one of the luminous chamber is made to emit a light. This asymmetry in the light distribution characteristic will be first described hereunder with reference to another embodiment of the discharge lamp.

Figure 4A:
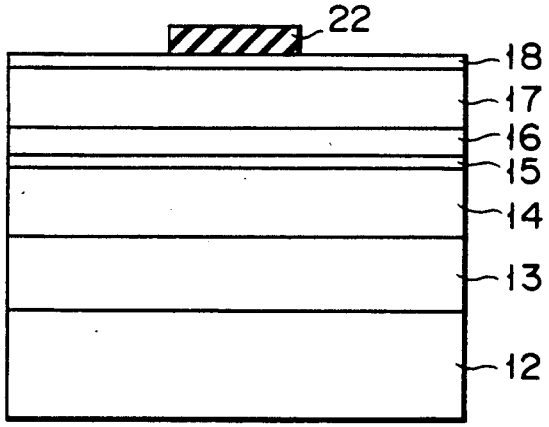
FIG. 4A is a plan view of the modified embodiment of a discharge lamp shown in FIG. 1.
Figure 4B:
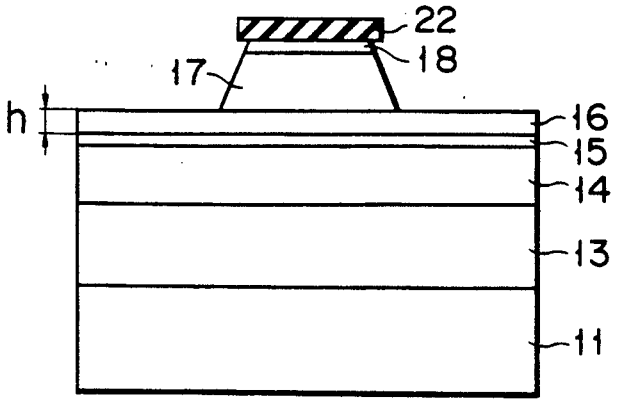
FIG. 4B is a sectional view taken along the line IV-B—IVB shown in FIG. 4A.
Figure 5:
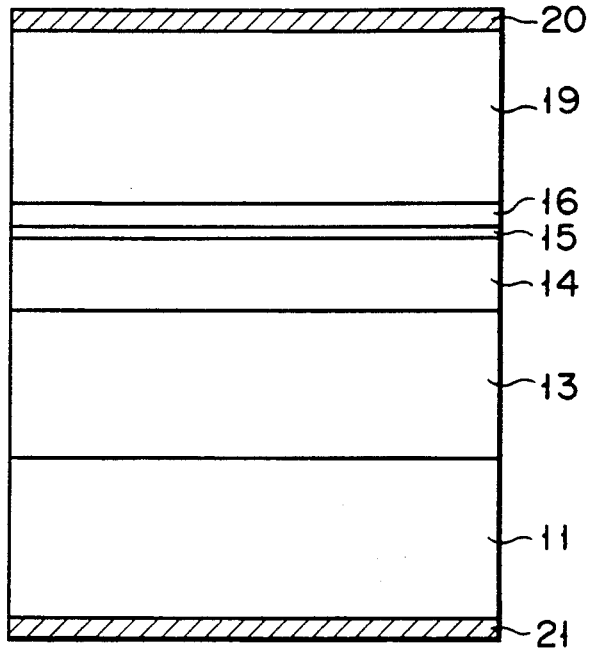
FIG. 5 is a developed perspective view of the modified discharge lamp shown in FIGS 4A and 4B.

The embodiment shown in FIGS. 4A, 4B and 5 is of a structure substantially identical to that shown in FIGS. 1 to 3 mainly except for the arrangements of the anodes and the shape of the outer casing of the discharge lamp, which is referred to as a fluorescent lamp hereinafter as a typical example, but the differences in these elements are substantially matters of design.

As shown in FIG. 5, the fluorescent lamp 101 is constructed such that a bottom stem 104 provided with a cathode 103 vertically thereon is fitted close and fixed in a lamp casing as an enclosure 102 of stainless steel make or the like which is formed like a bottomed cylinder with a frit glass filled in the outer periphery thereof and an exhaust tube 104*a* is extended air-tightly outward through a bottom portion center hole 102*h* of the lamp casing 102.

The lamp casing 102 has an open upper portion expanded into a rectangular tube form in order in two steps, thereby forming an upper stage 102*a* and a lower stage 102*b* square, for example, in plane.

The lamp casing 102 has the overall inner peripheral surface coated with a glass screen, not indicated. When a discharge is generated in the lamp casing 102, an impure gas charged therein will be prevented from coming out of the metallic lamp casing 102 by a glass screen.

Next, a tapering tube 106 funneled in the longitudinal section which is expanded taperingly upward, in FIG. 5, is inserted coaxially and so fixed in the lamp casing 102 with a frit glass filed in the upper periphery thereof. The tapering tube 106 substantially corresponds to the discharge regulating member 8 in the foregoing embodiment.

A diaphragm 108, substantially corresponding to the crossed partitioning plate 11 in the first embodiment, crossed, for example, in plane is inserted and fixed coaxially in the tapering tube 106, dividing the tapering tube 106 into four luminous chambers 108*a*, 108*b*, 108*c* and 108*d* internally as shown, for example, in FIG. 4A.

A fluorescent screen 109 varying in luminous color at the respective luminous chambers 108*a* to 108*d*, for example, is coated on each inside of a tapering plate 106*c* of the tapering tube 106 facing on the luminous chambers and also on each outside of the diaphragm 108 and, thus, the tapering tube 106 is constructed as a fluorescent screen adhered.

A top of the tapering tube 106 is formed into a quadrangular truncated pyramid tapering downward (FIG. 5), all corners of the upper end portions are notched as 106*a*, 106*a* —, a lower portion is integrated with a cylindrical straight drum portion 106*d*, and a circular discharge hole 106*b* is perforated in a bottom portion of the straight drum 106*d*.

The tapering tube 106 is locked and supported on the inside of each corner of the lower stage 102*b* in the lamp casing 102. Then, anodes 110*a* to 110*d* or a plurality of electrodes are formed like a circular loop and disposed coaxially on upper end of the luminous chambers 108*a* to 108*d* in the tapering tube 106.

Upper end portions of pinlike lead wires 111, 111—or feeders are fixed coaxially on each outer peripheral portion of the anodes 110*a* to 110*d*, tips of the lead wires 111, 111—are passed air-tightly through a bottom portion of the lower stage 102*b* of the lamp casing 102 vertically and thus extended externally for the electrical connection to a lighting circuit, not shown.

Next, with a frit glass filled in the outer periphery, a light transmissive plate 112 of rectangular platelike transparent glass is fitted and fixed within the upper stage 102*a* of the lamp casing 102.

Thus, the lamp casing 102 is sealed up in an air tight manner, whereby the discharge pipe 104*a* is passed into the lamp casing 102 to discharge air, silver and rare gas are charged therein on the other hand, and the light transmissive plate 112 is intended for luminous face of the fluorescent lamp 101.

However, according to the fluorescent lamp 101 of the type described above, the light distribution characteristic becomes asymmetric in the case of so-called single chamber light emission where only one of the luminous chambers 108*a* to 108*d* is made to emit a light, thus being difficult to uniform the luminance.

Figure 6:
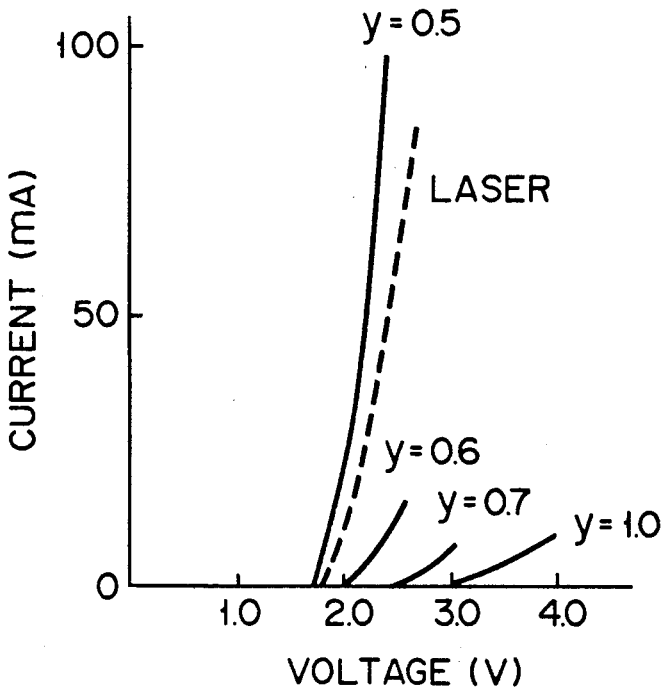
FIGS. 6 and 7 are sectional views similar to that shown in FIG. 4B for explanation of the operation of the discharge lamp.

Further, there is a problem such that a chromaticity of the white light at the time of all-chamber light emission deteriorates due to the asymmetric light distribution. That is as shown in FIG. 6, from conducting the cathode 103 and a single anode 110*c*, for example, to discharge a positive column $\alpha$ is formed between the cathode 103 and the single anode 110*c*, and a part of the positive column $\alpha$ passes into the luminous chamber 108*c* in the tapering tube 106 having the anode 110*c* in conduction.

In this case, the positive column $\alpha$ excites a mercury atom of the luminous chamber 108*c* to generate ultraviolet rays (UV), the UV rays excite the fluorescent screen 109 on an inside of the tapering tube 109 to emit a light of desired color, which is radiated externally from the light transmissive plate 112.

However, since the fluorescent screen 109 is coated only on an inner peripheral surface of a tapering plate 106*c* of the tapering tube 106 and each outside of the diaphragm 108, and the positive column $\alpha$ passes between the cathode 103 and the anode 110*c* at a minimal distance, a left end in the illustration, of the positive column $\alpha$ concentrates on a nose of the anode 110*c*. A radial gap between the positive column and the fluorescent screen 109 of the tapering tube 106 is maximized at a large open end portion (end portion on the light transmissive plate 112 side) of the tapering tube 106.

Accordingly, a radial distance between the positive column and the fluorescent screen 109 becomes maximized and intensity of irradiation of UV rays is minimized to a low luminance.

On the other hand, the intensity of irradiation of UV rays becomes maximized at a contracted end portion of the tapering tube 106 where a radial distance between the positive column $\alpha$ and the fluorescent screen 109 is minimized and, thus, a high luminance zone $l\ h_1$ (FIG. 7) is distributed here. For the sake of illustration, a luminance of the luminous chamber 108*c* is indicated in the neighboring chamber 108*d* in FIG. 7.

Figure 7:
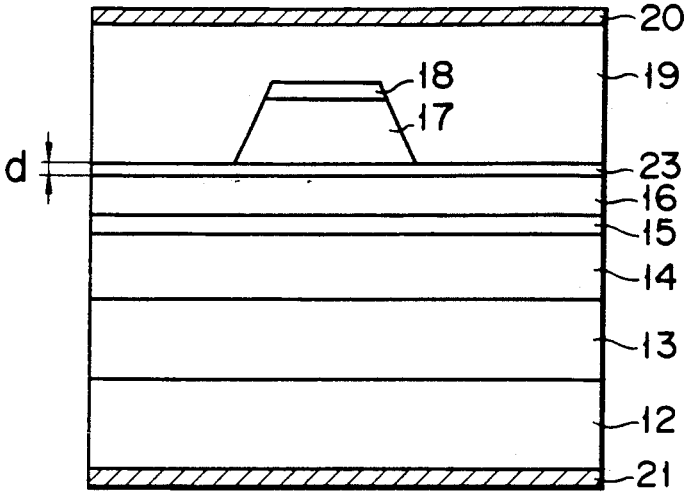
Figure 8A:
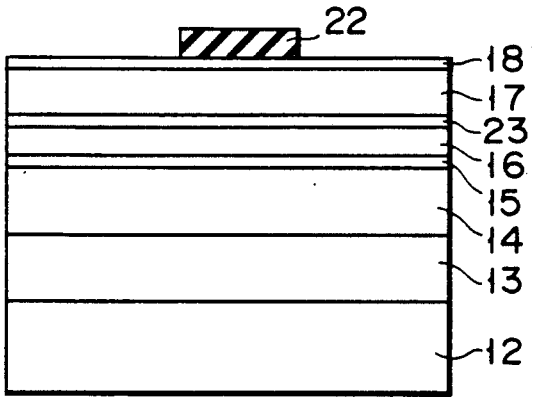
FIG. 8 is a graph representing a light distribution characteristic of the discharge lamp shown in FIG. 4B, for example.
Figure 8B:
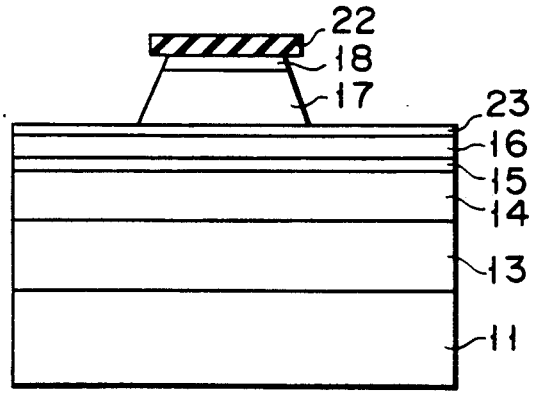
Figure 9:
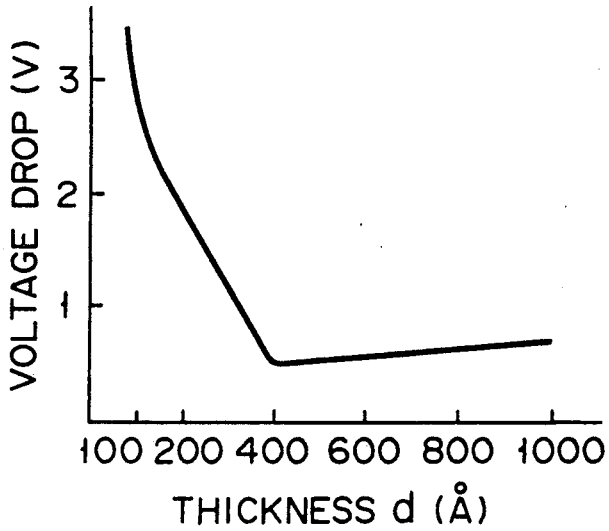
FIG. 9 is a plan view of the second embodiment of a discharge lamp according to the present invention.

The light l at the high luminance zone $l\ h_1$ comprises lights $l\ g_1$ and $l\ g_2$, emitted through the fluorescent screen 109 of both the tapering tube 106 and the diaphragm 108 on a side of the outer periphery P of the light transmissive plate 112 as shown in FIG. 7. However, a light $l\ o_1$ through the fluorescent screen 109 only is influential on a side of the center O and the equation $l\ g_1+l\ g_2>l\ o_1$ is established.

That is, no light is emitted through the fluorescent screen 109 and the light $l\ o_1$ emitted toward the center O on the contracted portion side from a position where the light is emitted in the high luminance zone $l\ h_1$ of the tapering tube 106 is shaded at the left end portion of the diaphragm 108.

Figure 8:
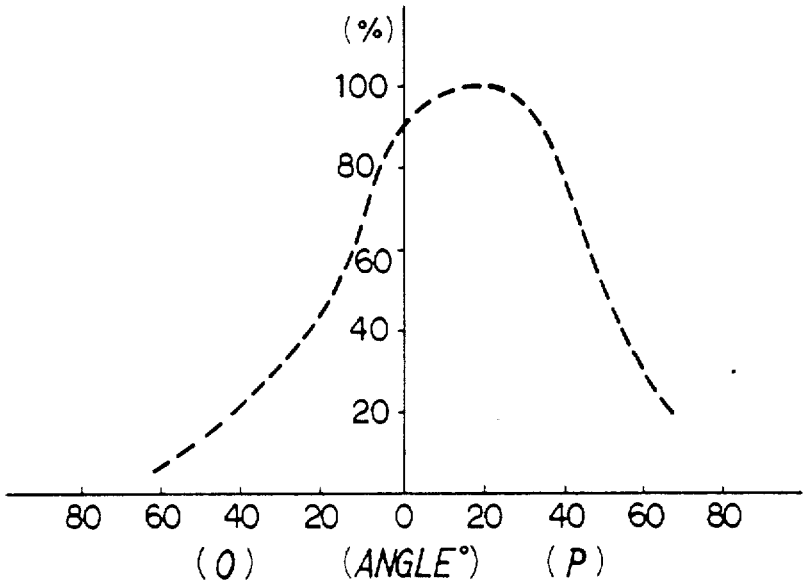
Figure 9:
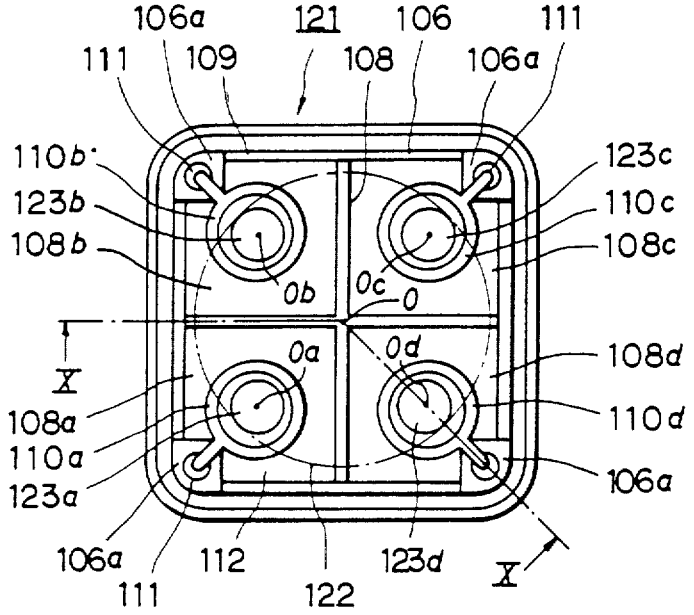
Figure 10:
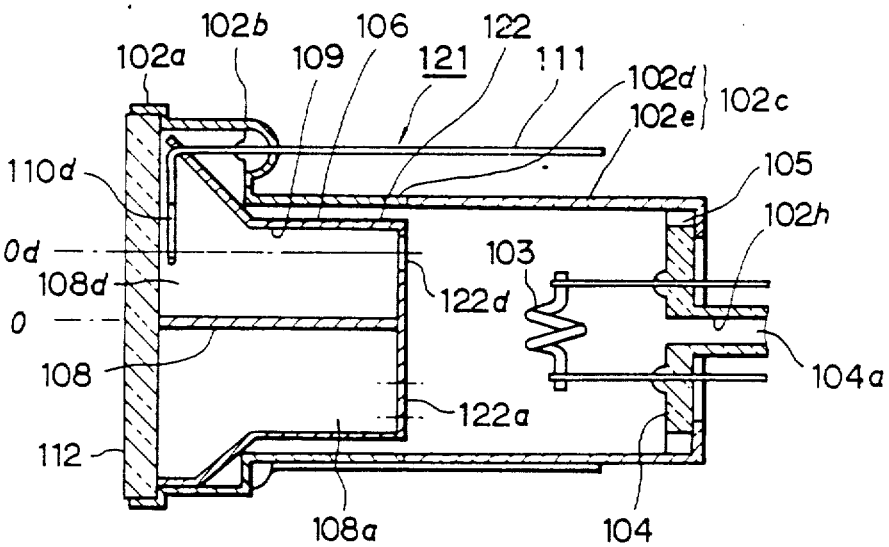
Figure 11:
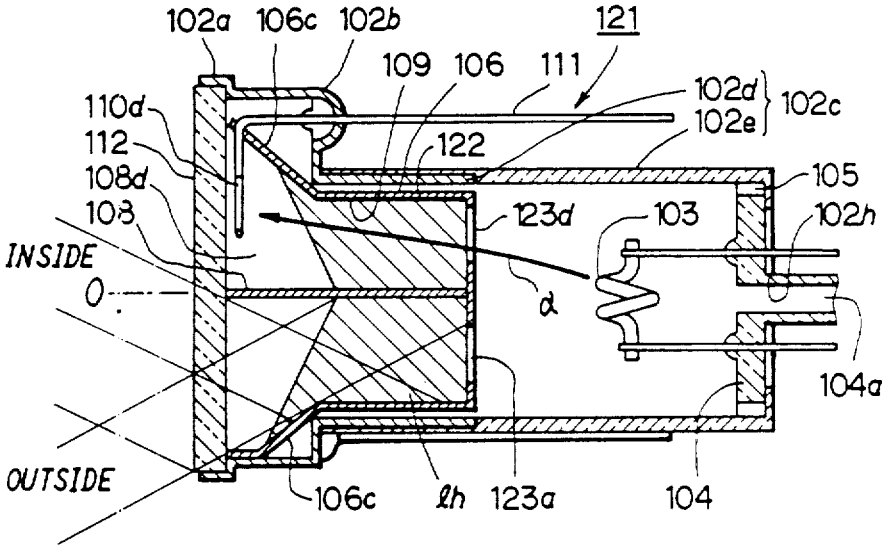
Figure 12:
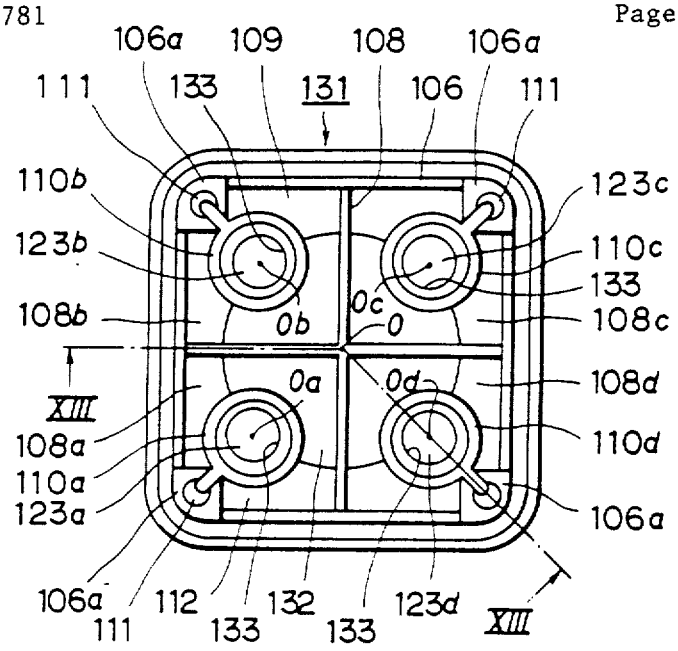
Figure 13:
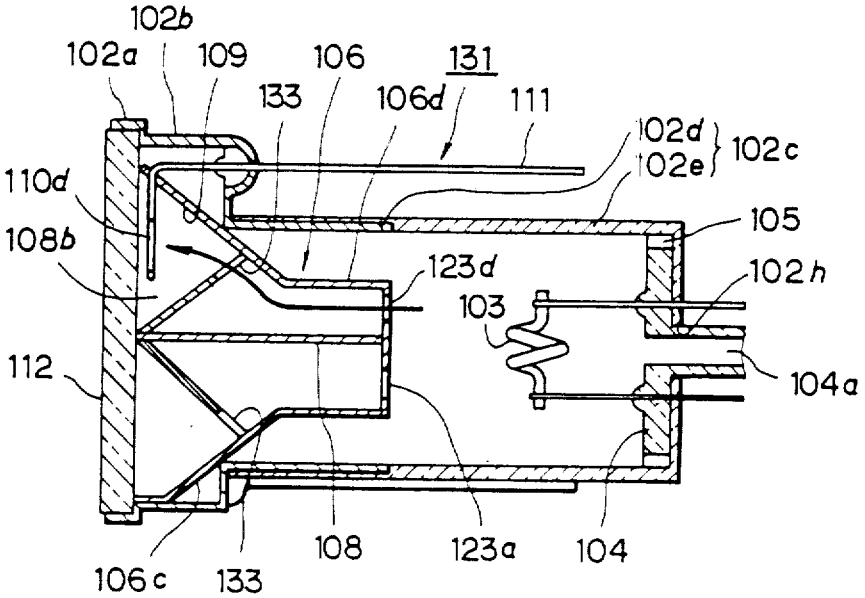

Accordingly, as shown in FIG. 8 by a broken line, the light distribution characteristic of such single-chamber light emission indicated that the quantity of light on the outer periphery side P of the fluorescent lamp 101 becomes more than the quantity of light on the center side O and, hence, the light distribution characteristic, when a center $O_0$ of the single luminous chamber 108*c* is regarded as the central axis, becomes asymmetric inside and outside, left and right sides as viewed, indicating that it is thick on the outer periphery side, i.e. outside, but thin on the center O side.

Since the luminous chambers 108*a*, 108*b* and 108*d* other than the luminous chamber 108*c* are of construction similar to the luminous chamber 108*c*, such asymmetry of the light distribution characteristic at the time of single-chamber light emission may arise likewise.

Then, since such single-chamber light emission has an asymmetric light distribution as described, in case all the anodes 110*a* to 110*d* are conducted to operate all the luminous chambers 108*a* to 108*d* for the light emission and the luminous colors are synthesized to generate a white light, the light distribution characteristic also becomes asymmetric inside and outside, i.e. left and right, with the center O of the fluorescent lamp 101 chromaticity of the white color deteriorates.

For the reason described, the white light may look to be tinged with red, blue and the like according to which way the fluorescent lamp 101 as the discharge lamp is observed.

Accordingly, to the other embodiments of the present invention, the above described problem regarding the asymmetric light distribution characteristic can be improved and the preferred embodiments will be described hereunder with reference of FIGS. 9 to 14, in which such portions or elements given in these figures as are common to those of FIGS. 4 and 5 are identified by the same reference numerals and, hence, a further description will be omitted herein for such portions.

Figure 10:
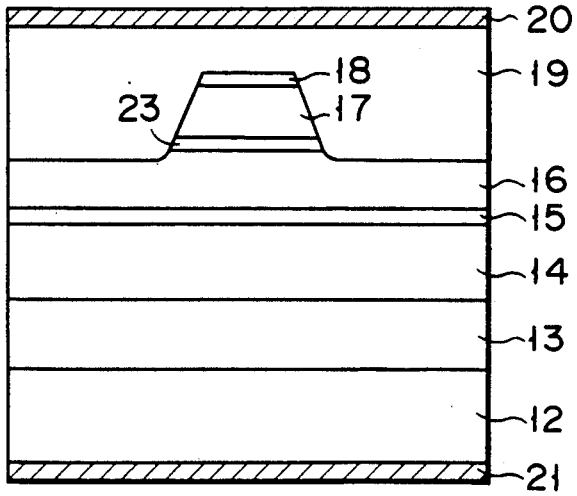
FIG. 10 is a sectional view taken along the line X—X shown in FIG. 9.

As shown in FIG. 10, a fluorescent lamp 121 of this embodiment is characterized in that a straight drum portion 122 of the tapering tube 106 is expanded near to an inside diameter of the lamp casing 102 and discharge holes 123*a*, 123*b* 123*c*, each in circular shape for example, are perforated each in a bottom portion (right end in FIG. 10) of the straight drum portion 122 coaxially with central axes Oa, Ob, Oc and Od of the luminous chambers 108*a* to 108*d*.

That is, according to the fluorescent lamp 121 of this embodiment, the tapering tube 106 is shaped like a straight drum as a whole by expanding the straight drum portion 122 and an out-of-symmetry of the form of the luminous chambers 108*a* to 108*d* when the central axes Oa to Od thereof are regarded as an axis of symmetry is enhanced.

By expanding the straight drum portion 122 as described, the outside or a luminous surface of the light transmissive plate 112 is made to have the portion capable of observing a fluorescent screen on the inner peripheral surface of the straight drum portion 122 expanded as far as the deep portion (right end as illustrated) when observing from the central side (inside) inclined by a predetermined angle from the central axis O or the outer peripheral portion (outside). Since the straight drum portion 122 is asymmetric inside and outside (left and right) in its form, the area ready for observing is almost symmetric inside and outside (left and right).

Meanwhile, what influences an out-of-symmetry of the light distribution characteristic to a great extent is a visibility of the fluorescent screen around the discharge holes 123*a* to 123*d* where luminance gets high for concentration of the positive column.

The out-of-symmetry is taken satisfactory where a portion with high luminance can be observed horizontally, but otherwise, since the discharge hole 106*b* comes near to the diaphragm 108 as shown, for example, in FIG. 4B, the fluorescent screen with high luminance which is near to the discharge hole 106*b* is interrupted by a left end portion of the diaphragm 108 and cannot be observed visually in the direction diagonal of the diaphragm 108 side. When observing in the direction counter to the diaphragm 108 to the contrary, the screen with high luminance which is near to the discharge hole 106*b* can be observed, thus deteriorating the out-of-symmetry horizontally.

Figure 11:
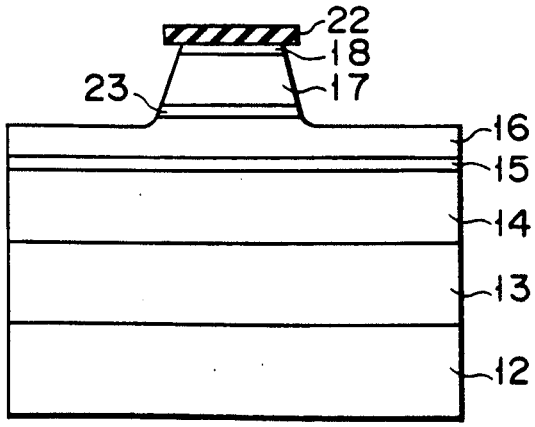
FIG. 11 is a view similar to that shown in FIG. 10 for explanation of the operation of the discharge lamp shown in FIG. 9 or 10.

On the other hand, in the case of fluorescent lamp 121 of this embodiment, the discharge hole 123*a* to 123*d* for contracting the positive column $\alpha$ are present at each center of the luminous chambers 108*a* to 108*d* as shown in FIG. 11, whereby the portion where the luminance is high can be observed symmetrically left and right.

Then, the positive column $\alpha$ is contracted through the discharge holes 123*a* to 123*d*, so that the luminance gets high in the vicinity thereof. However, since the high luminance zone l h is distributed in the straight drum portion 122 where each shape of the luminous chambers 108*a* to 108*d* becomes substantially symmetrical, the out-of-symmetry is satisfactory as compared with the case where the tapering plate 106*c* and the straight drum portion 106*d* are present around the discharge hole 106*b* as shown in FIG. 4.

As a result, the out-of-symmetry inside and outside of a general light distribution characteristic of the fluorescent lamp 121 can sharply be improved.

In the illustrated embodiment, such as shown in FIG. 10, the portion 102*c* extending from the lower staged portion 102*b* of the lamp casing 102 is formed by a metallic cylinder portion 102*d* which has an axial length substantially equal to that of the straight drum portion 122 and a cylindrical member 102*e* made of transparent glass which is disposed so as to tightly surround the outer periphery of the metallic portion 102*d*. The glass cylindrical member 102*e* extends axially leftwardly as viewed and the front end thereof is connected to the bottom stem 104 by the like manner described with reference to FIG. 7 or 8. The application of the transparent glass cylindrical member allows the visual observation of the cathode 103 arrangement. It is also to be understood by persons in the art that the application of the transparent glass cylindrical member 102*e* can be made to the embodiment shown in FIGS. 1 to 3 with substantially no problem. In addition, the generation of the impure gas from the metallic portion 102*d* can be reduced by shortening the length thereof. Furthermore, it is desired that the transparent glass cylindrical portion 102*e* is made to have the same wall thickness throughout the axial length thereof for the working purpose as shown in FIG. 10, but it may be made as shown in FIG. 11.

The operation of the embodiment will be described hereunder.

When the necessary anode, 110*d* for example, and the cathode 103 are conducted for a single-chamber emission of the fluorescent lamp 121, the positive column α is formed between the cathode 103 and the anode 110*d* in conduction.

The positive column α comes into the luminous chamber 108*d* enclosing the anode 110*d* in conduction therein through the discharge hole 123*d*, travels along the central axis Od of the luminous chamber 108*d* and then reaches the anode 110*d*.

Thus, the positive column α excites a mercury atom in the luminous chamber 108*d* to generate ultraviolet rays (UV), the UV rays excite the tapering plate 106*c* of the luminous chamber 108*d* and the fluorescent screen in the straight drum portion 122, which are luminous in desired color to a single chamber emission and the light is emitted outward from the light transmissive plate 112.

According to this embodiment, since the positive column α in the luminous chamber 108*d* passes nearly along the central axis Od of the luminous chamber 108*d*, an out-of-symmetry inside and outside with the central axis of symmetry is improved for the light distribution characteristic of the luminous chamber 108*d*.

The luminous chambers being all of the construction, a similar effect in improving the out-of-symmetry of the light distribution characteristic is secured likewise for the other luminous chambers 8*a* to 8*c*.

The open end portion of the tapering tube 106 around the light transmissive plate 112 is expanded taperingly, so that the light around the discharge holes 123*a* to 123*d* is ready for emitting externally.

Figure 12:
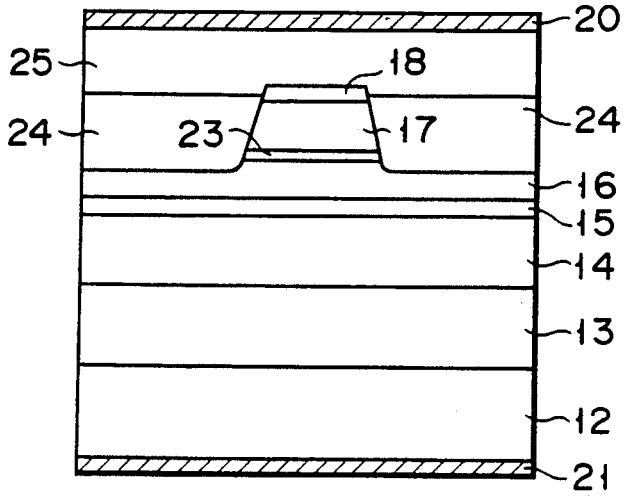
FIG. 12 is a plan view of the third embodiment of a discharge lamp according to the present invention.
Figure 13:
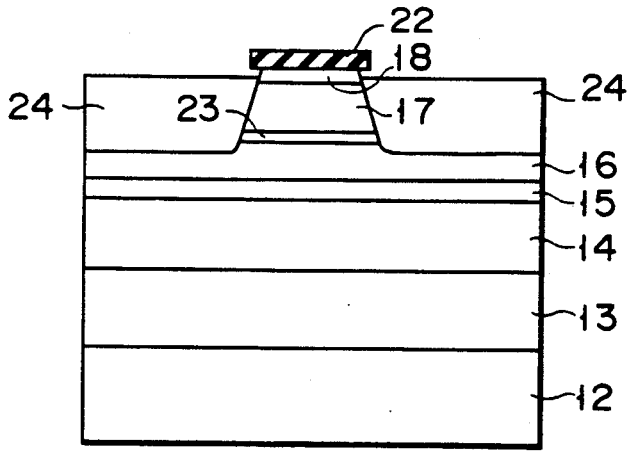
FIGS. 13 and 14 are sectional views taken along the line XIII—XIII shown in FIG. 12.
Figure 1:
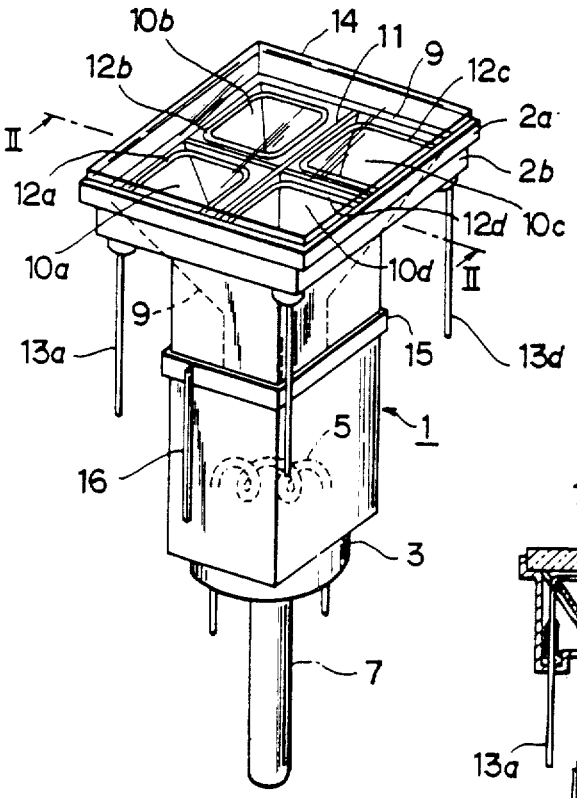

FIGS. 12 and 13 represent a general construction of another embodiment according to the present invention and referring to these figures, a fluorescent lamp 131 of this embodiment is characterized in that a circular cone 132 counter to the tapering plate 106*c* for the direction in which it is expanded taperingly is provided coaxially within the tapering plate 106*c* of the tapering tube 106 (fluorescent screen adhered), but is constructed similarly to the fluorescent lamp 101 shown in FIGS. 4 and 5, otherwise, whereby the parts common to those of FIGS. 7 and 8 are identified by the same reference numerals and a further description thereof will be omitted herein.

The circular cone 132 has a top coinciding nearly with a left end portion of the crossed diaphragm 108 and a conical expanded end portion fixed on an inside of the tapering plane 106*c*. Accordingly, tapering holes 132*a* of the circular cone 132 are disposed symmetrically in the luminous chambers 108*a* to 108*d* around the central axis O of the fluorescent lamp 131. Each tapering wall 132*a* of the circular cone 132 is coated with a fluorescent screen luminous in the same color as each fluorescent screen 109 in the luminous chamber 108*a* to 108*d*.

The circular cone 132 is provided with a semicircular notch 133 overlapping with each inner peripheral portion of the discharge holes 123*a* to 123*d* of the luminous chambers 108*a* to 108*d*, respectively. Accordingly, the positive column α indicated by a thick arrow in FIG. 13 can be passed through the central axes Oa to Od in the luminous chambers 108*a* to 108*d*. Each tapering wall 132*a* of the circular cone 132 and each tapering plane 106*c* are kept opposite each other so as to be expanded toward the light transmissive plane 112, whereby a mutual reflection may result between fluorescent screen on the tapering walls 132*a* and the fluorescent screen 109 of the tapering plate 106*c*, thus enhancing the luminance.

Figure 14:
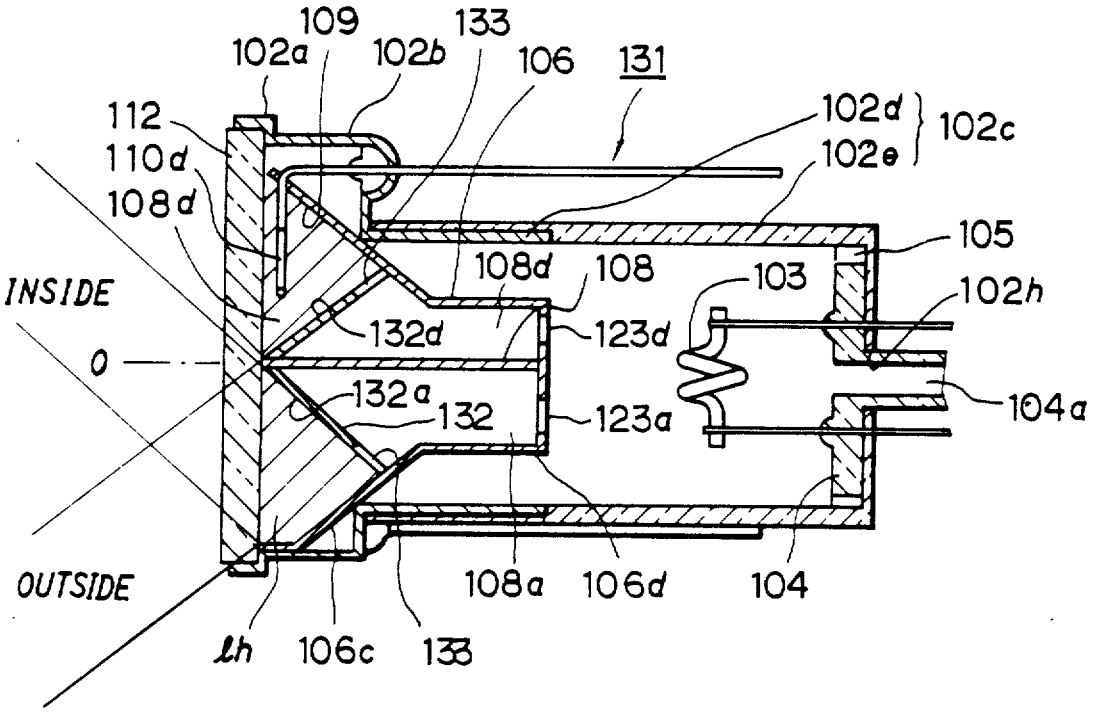

Then, the reflected light of high luminance is emitted externally by tapering angles of the tapering wall 132*a* and the tapering plate 106*c* through the light transmissive plate 112 and, accordingly, the high luminous zone l h is distributed on the portion indicated by an oblique line in FIG. 14.

In the fluorescent lamp 131 each form of the luminous chambers 108*a* to 108*d* is constructed symmetrically inside and outside (left and right) with reference to the central axes Oa to Od of the luminous chambers 108*a* to 108*d*, whereby the out-of-symmetry of the light distribution characteristic of the luminous chambers 108*a* to 108*d* can be improved.

Accordingly, a light distribution characteristic of the fluorescent lamp 131 comprising all of the luminous chambers 108*a* to 108*d* is also improved to be substantially symmetrical inside and outside with reference to the central axis O.

It is to be understood by persons skilled in the art that the present invention is not limited to the preferred embodiments described hereinabove and many other changes or modifications may be made without departing from the scope of the appended claims.

Figure 15:
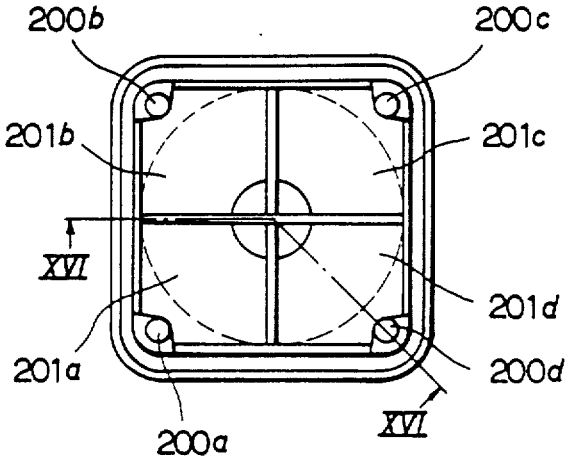
FIG. 15 is a plan view showing a modification of the discharge lamp shown in FIG. 7, for example.
Figure 16:
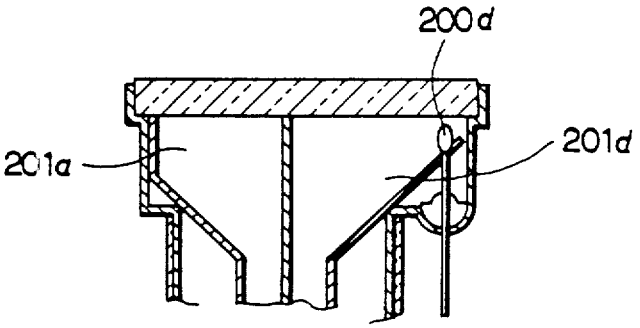
FIG. 16 is a sectional view, partially eliminated, taken along the line XVI—XVI shown in FIG. 15.
Figure 17:
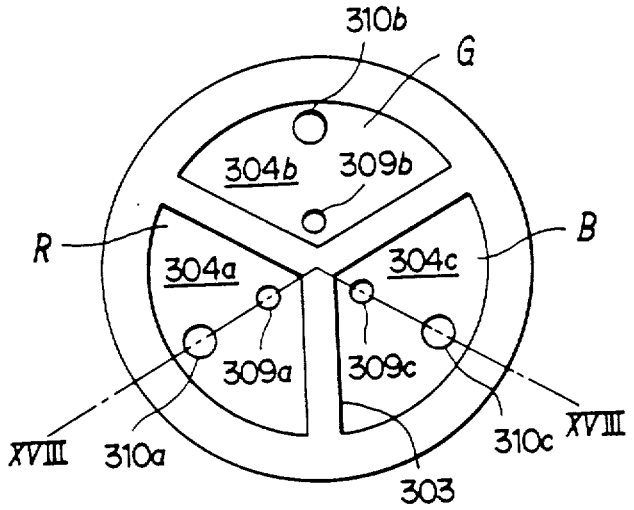
FIG. 17 PRIOR ART
FIG. 17 is a plan view of one example of a conventional discharge lamp.
Figure 18:
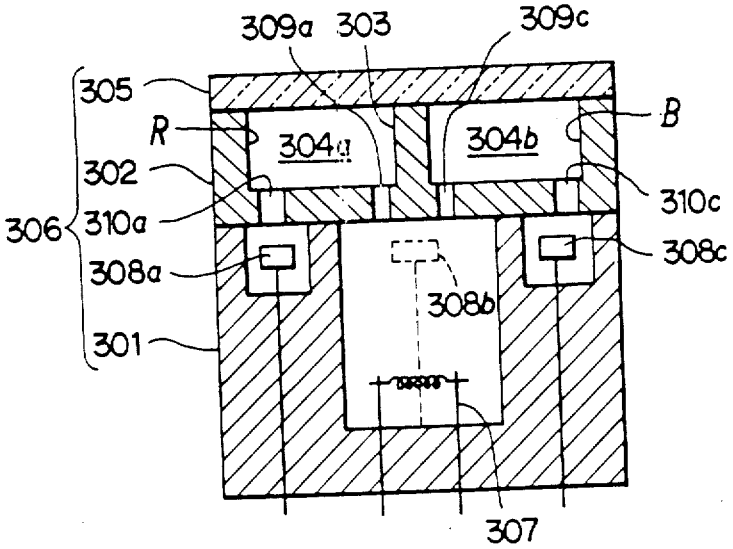
FIG. 18 PRIOR ART
FIG. 18 is an elevational section taken along the line XVIII—XVIII shown in FIG. 17.

For example, with a fluorescent lamp of the character described above in which the anodes are arranged in opposing manner to the cathode accommodated in the luminous chambers, the pinlike anodes 200*a* to 200*d* may be disposed at the corner portions of the luminous chambers 201*a* to 201*d* such as shown in FIGS. 15 and 16, FIG. 15 being a plan view and FIG. 16 being an elevational section, partially eliminated. Regarding the arrangement of other elements and portions shown in FIGS. 15 and 16 are substantially the same as those described with reference to the foregoing embodiments, so that the description thereof will be omitted herein.

Further, the arrangements of the cathode and anodes may be substituted with each other.

What is claimed is:

1. A discharge lamp comprising:

a metallic cylindrical lamp casing opened at both ends thereof, the cylindrical lamp casing comprising a first staged portion for supporting air-tightly the transparent glass plate, a second staged portion formed downward said first staged portion and a portion downwardly extending from the second staged portion, said first and second staged portions and said extending portion being formed integrally with each other;

a transparent glass plate air-tightly fitted to one of the opened ends of said lamp casing;

a sealing means air-tightly closing an other opened end of said lamp casing; and a pair of electrodes sealed in said lamp casing together with discharge gas.

2. A discharge lamp according to claim 1, wherein an inner surface of said metallic cylindrical lamp casing is coated with a glass film coating.

3. A discharge lamp according to claim 1, wherein said sealing means sealing the other end of said lamp casing comprises a button stem and wherein one of said electrodes is disposed near said transparent glass plate and the other of said electrodes is embedded in said button stem.

4. A discharge lamp according to claim 3, wherein said one of electrodes is an anode means and the other one of electrodes is a cathode means.

5. A discharge lamp according to claim 1, wherein an outer electrode is disposed around an outer periphery of said further extending portion of said lamp casing.

6. A discharge lamp according to claim 1, wherein said first and second staged portions and said further extending portion are each of square cross section.

7. A discharge lamp according to claim 1, wherein said first and second staged portions are each of square cross section and said further extending portion is of circular cross section.

8. A discharge lamp according to claim 1, wherein said further extending portion comprises a metallic cylindrical portion extending to a half way of an axial length of said cylindrical lamp casing and a cylindrical transparent glass portion tightly surrounding an outer periphery of said metallic cylindrical portion of the further extending portion and having a front end extending to the sealing means closing the other end of the lamp casing.

9. A discharge lamp comprising:

a metallic cylindrical lamp casing opened at both ends thereof;

a transparent glass plate air-tightly fitted to one of the opened ends of said lamp casing;

a sealing means air-tightly closing the other opened end of said lamp casing; and a pair of electrodes sealed in said lamp casing together with discharge gas;

means for regulating discharge generated between said paired electrodes, said discharge regulating means being supported in said lamp casing by a staged portion.

10. A discharge lamp according to claim 9, wherein said discharge regulating means comprises a main body formed in quadrangular truncated pyramid shape having downwardly forwardly tapered end and a cylindrical portion formed integrally with the tapered end portion of the main body, an upper open end of said main body has a shape substantially corresponding to an inner periphery of said one open end of said lamp casing and said cylindrical portion extending from the tapered lower end of the main body being of a cross section in conformity with a cross section of said further extending portion.

11. A discharge lamp according to claim 10, wherein said cylindrical portion extending from the tapered lower end of said main body has an outer diameter substantially equal to an inner diameter of said further extending portion of the lamp casing.

12. A discharge lamp according to claim 10, wherein said discharge regulating means further comprising a crossed partition plate as a diaphragm partitioning an interior of said main body into a plurality of luminous chambers each of the same shape.

13. A discharge lamp according to claim 12, wherein said cylindrical portion extending from the tapered lower end portion of said main body has a bottom end provided with a discharge hole acting for throttling a positive column generated during the discharge between said paired electrodes, said discharge hole being arranged on a central axis of each luminous chamber.

14. A discharge lamp according to claim 12, wherein inner walls of said luminous chamber are coated with light emitting substance and one of said electrodes is arranged for each luminous chamber so as to constitute the discharge lamp as a fluorescent lamp.

15. A discharge lamp according to claim 12, further comprising a circular conical member being counter to the tapering portion of the main body for a direction being expanded taperingly and being provided coaxially within the tapering portion, a top end portion of said circular conical member being coincident with a crossed end portion of said crossed partition plate.

16. A discharge lamp according to claim 15, wherein said cylindrical portion extending from the tapered lower end portion of said main body has a bottom end provided with a discharge hole acting for throttling a positive column generated during the discharge between said paired electrodes, said discharge hole being arranged on a central axis of each luminous chamber.

* * * * *

UNITED STATES PATENT AND TRADEMARK OFFICE

CERTIFICATE OF CORRECTION

PATENT NO. : 5,049,781

DATED : Sep. 17, 1991

INVENTOR(S) : Hitoshi Imamura, et al.

It is certified that error appears in the above-identified patent and that said Letters Patent is hereby corrected as shown below:

The title page, showing the illustrative figure, should be deleted to be replaced with the attached title page.

Drawing Sheets 1-6, consisting of Figs. 1-13, should be deleted and substitute therefor Figs. 1-18, as shown on the attached pages.

Signed and Sealed this

Fifth Day of May, 1992

*Attest:*

DOUGLAS B. COMER

*Attesting Officer*

*Acting Commissioner of Patents and Trademarks*

United States Patent [19]

Imamura et al.

[11] Patent Number: 5,049,781

[45] Date of Patent: Sep. 17, 1991

[54] DISCHARGE LAMP

[75] Inventors: Hitoshi Imamura, Yokohama; Jyunichi Nakajima, Tokyo; Shigeru Okada; Katsuyuki Ide, both of Yokohama, all of Japan

[73] Assignee: Toshiba Lighting and Technology Corporation, Tokyo, Japan

[21] Appl. No.: 478,964

[22] Filed: Feb. 12, 1990

[30] Foreign Application Priority Data

Mar. 31, 1989 [JP] Japan ..... 64-78646

[51] Int. Cl.[5] ..... H01J 17/16; H01J 61/30

[52] U.S. Cl. ..... 313/634; 313/493; 313/489

[58] Field of Search ..... 313/493, 492, 485, 495, 313/609, 610, 634; 174/176 F, 17.05, 52.3

[56] References Cited

U.S. PATENT DOCUMENTS

| | | | |
|---|---|---|---|
| 4,344,016 | 8/1982 | Hoffmann et al. | 313/489 |
| 4,835,440 | 5/1989 | Imamura et al. | 313/492 |
| 4,924,143 | 5/1990 | Imamura et al. | 313/493 |

FOREIGN PATENT DOCUMENTS

| | | |
|---|---|---|
| 6414860 | 1/1989 | Japan . |
| 1105454 | 4/1989 | Japan . |

*Primary Examiner*—Sandra L. O'Shea

*Attorney, Agent, or Firm*—Oblon, Spivak, McClelland, Maier & Neustadt

[57] ABSTRACT

A discharge lamp comprises a cylindrical lamp casing substantially formed of a metallic material, a transparent glass plate air-tightly fitted to one of the opened end of the lamp casing, a sealing stem air-tightly closing the other opened end of the lamp casing, and a pair of cathode and anode elements sealed in the lamp casing together with discharge gas. The lower portion of the lamp casing may be made in square or circular structure and may be composed of a metallic cylindrical portion extending to a half way of an axial length of the cylindrical lamp casing and a cylindrical transparent glass portion tightly surrounding the outer periphery of the metallic cylindrical portion of the further extending portion and having a front end extending to the sealing stem closing the other end of the lamp casing. The discharge lamp further comprises a member for regulating discharge generated between the paired cathode and anode elements and the interior of the discharge regulating member is divided into a plurality of luminous chambers so that the discharge lamp operates as a fluorescent lamp. The improved structure of the discharge regulating member can improve the light distribution characteristic of the fluorescent lamp.

16 Claims, 6 Drawing Sheets

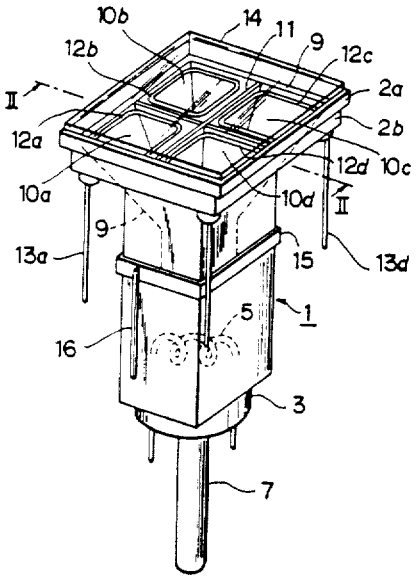

UNITED STATES PATENT AND TRADEMARK OFFICE

CERTIFICATE OF CORRECTION

PATENT NO. : 5,049,781

DATED : September 17, 1991

INVENTOR(S) : Hitoshi Imamura et al.

It is certified that error appears in the above-identified patent and that said Letters Patent is hereby corrected as shown below:

On the title page, Item [30],

The Foreign Application Priority Data is incorrect, should read as follows: --Mar. 31, 1989 [JP] Japan.....1-78646--

Signed and Sealed this

Twenty-sixth Day of October, 1993

*Attest:*

*Attesting Officer*

Bruce Lehman

BRUCE LEHMAN

*Commissioner of Patents and Trademarks*